US011713233B2

(12) United States Patent
Rudick

(10) Patent No.: US 11,713,233 B2
(45) Date of Patent: Aug. 1, 2023

(54) SYSTEMS AND METHODS FOR RATIONALIZING INGREDIENTS

(71) Applicant: The Coca-Cola Company, Atlanta, GA (US)

(72) Inventor: Arthur G. Rudick, Ormond Beach, FL (US)

(73) Assignee: THE COCA-COLA COMPANY, Atlanta, GA (US)

( * ) Notice: Subject to any disclaimer, the term of this patent is extended or adjusted under 35 U.S.C. 154(b) by 442 days.

(21) Appl. No.: 16/337,040

(22) PCT Filed: Sep. 29, 2017

(86) PCT No.: PCT/US2017/054253

§ 371 (c)(1),
(2) Date: Mar. 27, 2019

(87) PCT Pub. No.: WO2018/064454

PCT Pub. Date: Apr. 5, 2018

(65) Prior Publication Data

US 2020/0031652 A1 Jan. 30, 2020

Related U.S. Application Data

(60) Provisional application No. 62/402,091, filed on Sep. 30, 2016.

(51) Int. Cl.
*B67D 1/00* (2006.01)

(52) U.S. Cl.
CPC ..... *B67D 1/0034* (2013.01)

(58) Field of Classification Search
CPC ..... A23L 2/00; A23L 2/68; A23L 2/52; B67D 3/0019; B67D 1/0034–0038;
(Continued)

(56) References Cited

U.S. PATENT DOCUMENTS 3,940,019 A * 2/1976 Kross ..... B67D 1/0041 222/30
7,913,879 B2 * 3/2011 Carpenter ..... B67D 1/0085 222/129.4

(Continued)

FOREIGN PATENT DOCUMENTS

WO 0249458 A1 6/2002
WO 2006/058713 A1 6/2006
WO 2009032686 A1 3/2009

OTHER PUBLICATIONS

International Search Report and Written Opinion, PCT/US2017/054253, dated Jan. 8, 2018 (13 pp.).

*Primary Examiner* — Paul R Durand
*Assistant Examiner* — Michael J. Melaragno
(74) *Attorney, Agent, or Firm* — Eversheds Sutherland (US) LLP

(57) ABSTRACT

The present application provides a beverage dispensing system. The beverage dispensing system may include a nozzle, a first beverage component with a first ingredient in communication with the nozzle via a first pump, and a second beverage component with the first ingredient and a second ingredient in communication with the nozzle via a second pump. The first pump and the second pump may vary the flow rate of the first beverage component and the second beverage component to the nozzle to create different beverages.

13 Claims, 3 Drawing Sheets

(58) Field of Classification Search
CPC .. B67D 1/0041; B67D 1/0078; B67D 1/1284; B67D 1/1295; B67D 1/1297; B67D 2007/746
USPC ..... 222/145.1, 129.1, 145.5–145.6, 144.5, 222/132–137
See application file for complete search history.

(56) References Cited

U.S. PATENT DOCUMENTS 8,490,829 B2 * 7/2013 Deo ..... B67D 1/0034 222/57
8,516,902 B2 * 8/2013 Beavis ..... G05D 7/0617 73/861.47
9,010,577 B2 * 4/2015 Hoover ..... B67D 1/0021 222/129.4
10,046,959 B2 * 8/2018 Rudick ..... B67D 1/0021
2006/0251703 A1 * 11/2006 Shiao ..... A61K 36/73 424/439
2007/0205220 A1 * 9/2007 Rudick ..... B67D 1/07 222/129.4
2007/0205221 A1 * 9/2007 Carpenter ..... B67D 1/006 222/129.4
2007/0212468 A1 * 9/2007 White ..... A23L 2/52 426/590
2007/0267441 A1 * 11/2007 van Opstal ..... B67D 1/0857 222/129.4
2008/0142548 A1 * 6/2008 Moen ..... B67D 1/0043 222/129.1
2009/0014464 A1 * 1/2009 Adbelmoteleb ..... B67D 1/07 222/1
2009/0069934 A1 * 3/2009 Newman ..... B67D 1/0021 700/239
2009/0087539 A1 * 4/2009 Fry ..... A23L 2/52 426/590
2009/0159612 A1 * 6/2009 Beavis ..... A47J 31/36 222/52
2010/0133293 A1 * 6/2010 Ziesel ..... B67D 1/0046 222/1
2010/0237099 A1 * 9/2010 Carpenter ..... B67D 1/0051 222/129.4
2011/0121032 A1 * 5/2011 Deo ..... B67D 1/0032 222/145.1
2012/0074168 A1 * 3/2012 Newman ..... B67D 1/0022 222/129.4
2012/0228328 A1 * 9/2012 Ryan ..... B67D 1/0025 222/129.4
2012/0298692 A1 * 11/2012 Jersey ..... B67D 1/0037 222/129.1
2012/0325845 A1 * 12/2012 Newman ..... B67D 1/127 222/1
2013/0292407 A1 * 11/2013 Beavis ..... F04B 13/00 222/1
2013/0304265 A1 * 11/2013 Deo ..... B67D 1/0041 700/283
2013/0316066 A1 * 11/2013 Brown ..... A23L 2/56 426/590
2014/0107835 A1 * 4/2014 Biasi ..... B67D 1/0892 700/231
2014/0263411 A1 * 9/2014 Quartarone ..... B67D 1/0021 222/1
2014/0263413 A1 * 9/2014 Green ..... B67D 1/0065 222/1
2014/0263416 A1 * 9/2014 Green ..... B67D 1/0021 222/1
2014/0263454 A1 * 9/2014 Connerat ..... B67D 3/0067 222/153.06
2015/0034674 A1 * 2/2015 Hertensen ..... B67D 1/0801 222/129.1
2017/0043992 A1 * 2/2017 Green ..... B67D 1/0063
2019/0330043 A1 * 10/2019 Carpenter ..... B67D 1/0888
2020/0077678 A1 * 3/2020 Kamarei ..... A23L 2/38

* cited by examiner

| 160 | 180 | 170 | 190 |
|---|---|---|---|
| Beverage Component 1 (ml/sec) | Beverage Component 2 (ml/sec) | Ingredient 1 (ml/sec) | Ingredient 2 (ml/sec) |
| 10 | 0 | 2 | 0 |
| 7.5 | 0 | 1.5 | 0 |
| 5 | 0 | 1 | 0 |

FIG. 3

| 160 | 180 | 170 | 190 |
|---|---|---|---|
| Beverage Component 1 (ml/sec) | Beverage Component 2 (ml/sec) | Ingredient 1 (ml/sec) | Ingredient 2 (ml/sec) |
| 5 | 10 | 2 | 1 |
| 2.5 | 10 | 1.5 | 1 |
| 0 | 10 | 1 | 1 |

FIG. 4

| 160 | 180 | 170 | 190 |
|---|---|---|---|
| Beverage Component 1 (ml/sec) | Beverage Component 2 (ml/sec) | Ingredient 1 (ml/sec) | Ingredient 2 (ml/sec) |
| 5 | 10 | 2 | 1 |
| 6.25 | 7.5 | 2 | 0.75 |
| 7.5 | 5 | 2 | 0.5 |

FIG. 5

SYSTEMS AND METHODS FOR RATIONALIZING INGREDIENTS

TECHNICAL FIELD

The present application and the resultant patent relate generally to beverage dispensing systems and more particularly relate to systems and methods for rationalizing ingredients used in beverage dispensing systems so as to accommodate differing ingredient concentrations and ingredient combinations across differing beverages.

BACKGROUND OF THE INVENTION

Beverage dispensers traditionally have combined a diluent such as water with a beverage base such as a syrup. These beverage bases usually have a diluent reconstitution ratio of about three to one (3:1) to about six to one (6:1). The beverage bases usually come in large bag-in-box containers that may require significant amounts of storage space and may need to be refrigerated. These requirements often necessitate the need to store the bag-in-box containers far from the beverage dispenser and to run long lines from the containers to the beverage dispenser.

The "COCA-COLA FREESTYLE®" refrigerated beverage dispensing unit offered by the Coca-Cola Company of Atlanta, Ga. provides a significant increase in the number and types of beverages that may be offered by a beverage dispenser of a conventional size or footprint. Generally described, the "COCA-COLA FREESTYLE®" refrigerated beverage dispensing unit creates a beverage by combining a number of highly concentrated micro-ingredients with a macro-ingredient such as a sweetener and a diluent. The micro-ingredients generally are stored in cartridges positioned within the beverage dispenser itself. The number and type of beverages offered by the beverage dispenser thus may be limited only by the number and type of micro-ingredient cartridges positioned therein.

SUMMARY OF THE INVENTION

The present application and the resultant patent thus provide a beverage dispensing system. The beverage dispensing system may include a nozzle, a first beverage component with a first ingredient in communication with the nozzle via a first pump, and a second beverage component with the first ingredient and a second ingredient in communication with the nozzle via a second pump. The first pump and the second pump may vary the flow rate of the first beverage component and the second beverage component to the nozzle to create different beverages.

The present application and the resultant patent further provide a method of rationalizing ingredients in a beverage dispenser. The method may include the steps of flowing a first beverage component with a first ingredient to a nozzle, flowing a second beverage component with the first ingredient and a second ingredient to the nozzle, creating a first beverage brand by flowing the first beverage component to the nozzle at a first flow rate and flowing the second beverage component to the nozzle at a second flow rate, and creating a second beverage brand by flowing the first beverage component to the nozzle at a third flow rate and flowing the second beverage component to the nozzle at the second flow rate.

The present application and the resultant patent further provide a beverage dispensing system. The beverage dispensing system may include a nozzle and a product rationalization system in communication with the nozzle. The product rationalization system may include a first beverage component with a first ingredient in communication with the nozzle via a first pump and a second beverage component with the first ingredient and a second ingredient in communication with the nozzle via a second pump. The first pump and the second pump may vary the flow rate of the first beverage component and the second beverage component to the nozzle to create different beverages.

These and other features and improvements of the present application and resultant patent will become apparent to one of ordinary skill in the art upon review of the following detailed description when taken in connection with the several drawings and the appended claims.

BRIEF DESCRIPTION OF THE DRAWINGS

FIG. 3 is a chart showing varying ingredient flow rates in the product rationalization system of FIG. 2.

FIG. 4 is a chart showing varying ingredient flow rates in the product rationalization system of FIG. 2.

FIG. 5 is a chart showing varying ingredient flow rates in the product rationalization system of FIG. 2.

DETAILED DESCRIPTION

Figure 1:
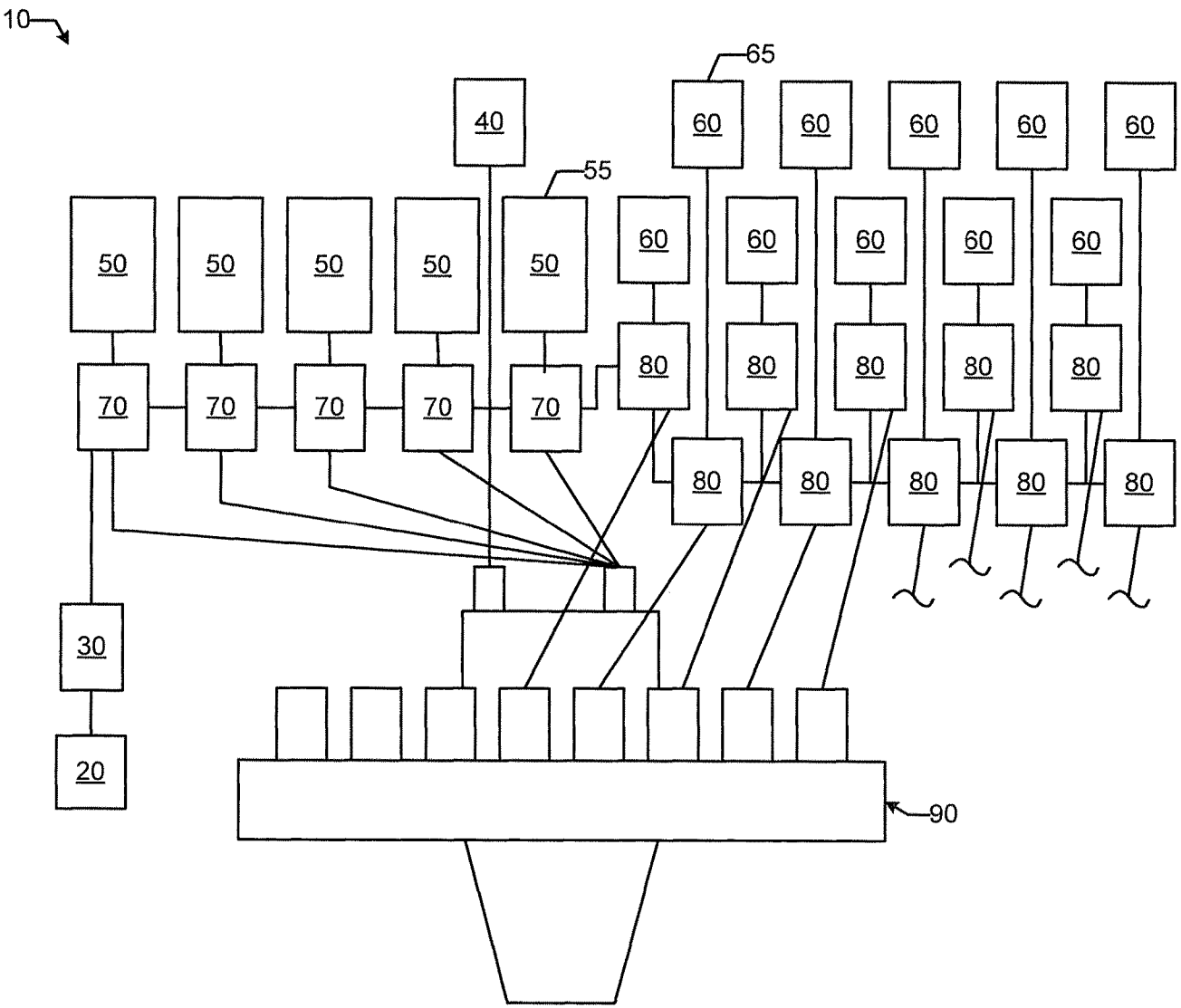
FIG. 1 is a schematic diagram of a beverage dispenser using macro-ingredients and micro-ingredients.

Referring now to the drawings, in which like numerals indicate like elements throughout the several views, FIG. 1 shows a beverage dispenser 10. The beverage dispenser 10 may have a user interface 20 to control all of the functional aspects thereof. A consumer may select and/or create numerous types of beverages, blends, and additives using the user interface 20. The beverage dispenser 10 also may have a control device 30. The control device 30 may be a conventional microcomputer or similar type of programmable device. The control device 30 may be internal to or remote from the beverage dispenser 10.

The beverage dispenser 10 may use any number of different ingredients. In this example, several different types of ingredients may be used: a diluent 40, one or more macro-ingredients 50, and a number of micro-ingredients 60. Any number or combination of the ingredients may be used herein to create any number of different beverages.

The diluent 40 may include plain and/or carbonated water. The diluent 40 may or may not be refrigerated. Other types of diluents may be used herein. A conventional carbonator or a similar type of device may be used to produce carbonated water as desired. The amount of carbonation may be varied.

Generally described, the macro-ingredients 50 may have reconstitution ratios in a range of about three to one (3:1) to about six to one (6:1). Viscosities of the macro-ingredients 50 typically range from about 100 or higher. By way of example, the macro-ingredients 50 may include sugar syrup, HFCS (high fructose corn syrup), juice concentrates, and similar types of fluids. Similarly, a macro-ingredient base product may include sweetener, acid, and other components. The syrups, sweeteners, and base products generally may be stored in a conventional bag-in-box container 55. The bag-in-box containers 55 and the macro-ingredients 50 may be positioned remote from the beverage dispenser 10 and/or positioned thereabout in whole or in part. The macro-ingredients 50 may or may not need to be refrigerated. Other types of macro-ingredients 50 may be used herein.

The micro-ingredients 60 may have reconstitution ratios ranging from about ten to one (10:1), twenty to one (20:1), thirty to one (30:1), or higher. Specifically, many micro-ingredients 60 may have a reconstitution ratio in the range of fifty to one (50:1), to three hundred to one (300:1), or more. Viscosities of the micro-ingredients 60 typically range from about 1 to about 7 centipoise or so. Examples of the micro-ingredients 60 include natural and artificial flavors; flavor additives, e.g., phosphoric acid; natural and artificial colors; artificial sweeteners (high potency, non-nutritive, or otherwise); additives for controlling tartness, e.g., citric acid, potassium citrate; functional additives such as vitamins, minerals, herbal extracts; nutraceuticals; and over-the-counter (or otherwise) medicines. The acid and non-acid components of the non-sweetened concentrate also may be separated and stored individually. The micro-ingredients 60 may be liquid, powder (solid), or gaseous form and/or combinations thereof. The micro-ingredients 60 may or may not require refrigeration. Non-beverage substances such as paints, dyes, oils, cosmetics, etc., also may be used. Various types of alcohols may be used as micro or macro-ingredients. Other types of micro-ingredients 60 may be used herein.

The micro-ingredients 60 may be stored in one or more cartridges 65. The cartridges 65 may have any suitable size, shape, or configuration. Any number of the cartridges 65 may be stored within the beverage dispenser 100. Preferably the micro-ingredients 60 in the cartridges 65 may be positioned within or about the beverage dispenser 10 itself as opposed to being remotely positioned in the conventional bag-in-box containers 55 as described above or otherwise. By being positioned about the beverage dispenser 10, we mean that the micro-ingredients 60 and the cartridges 65 are positioned in close proximity to the beverage dispenser 10 such as therein, adjacent thereto, underneath, or in other nearby positions. Alternatively, the micro-ingredients 60 and the like may be stored in conventional bag-in-box containers or other types of containers.

Although certain ingredients such as, for example, citric acid and phosphoric acid, may be used in a number of different beverage types, the amount and/or the concentration of these ingredients may vary by beverage type. Likewise, whether these ingredients may be used with or without other ingredients such as, for example, caffeine, also may vary by beverage type. As a result, a number of the micro-ingredient cartridges must be dedicated to these ingredients in differing concentrations and/or combinations.

The diluent 40, the macro-ingredients 50, and the micro-ingredients 60 may be in communication with a pump 70 and/or a metering device 80. The control device 30 may control the pumps 70 and the metering devices 80. Generally described, the diluent 40 and the macro-ingredients 50 each may be in communication with one of the pumps 70. The pumps 70 may include a positive displacement pump such as a gear pump or a similar type of device. The micro-ingredients 60 may be in communication with one of the metering devices 80. The metering device 80 may be a positive displacement pump or a similar type of device that provides portion control for the more highly concentrated micro-ingredients 60. The positive displacement pump may be a solenoid pump, a gear pump, an annular pump, a peristaltic pump, a syringe pump, a piezo pump, or any other type of positive displacement device that is designed to pump a fixed displacement for each pump cycle. The pumps 70 and the metering devices 80 may be in communication with a dispensing nozzle 90. The dispensing nozzle 90 preferably may be a multi-flavor dispensing valve capable of mixing a number of fluids at the same time. Other components and other configurations may be used herein.

Figure 2:
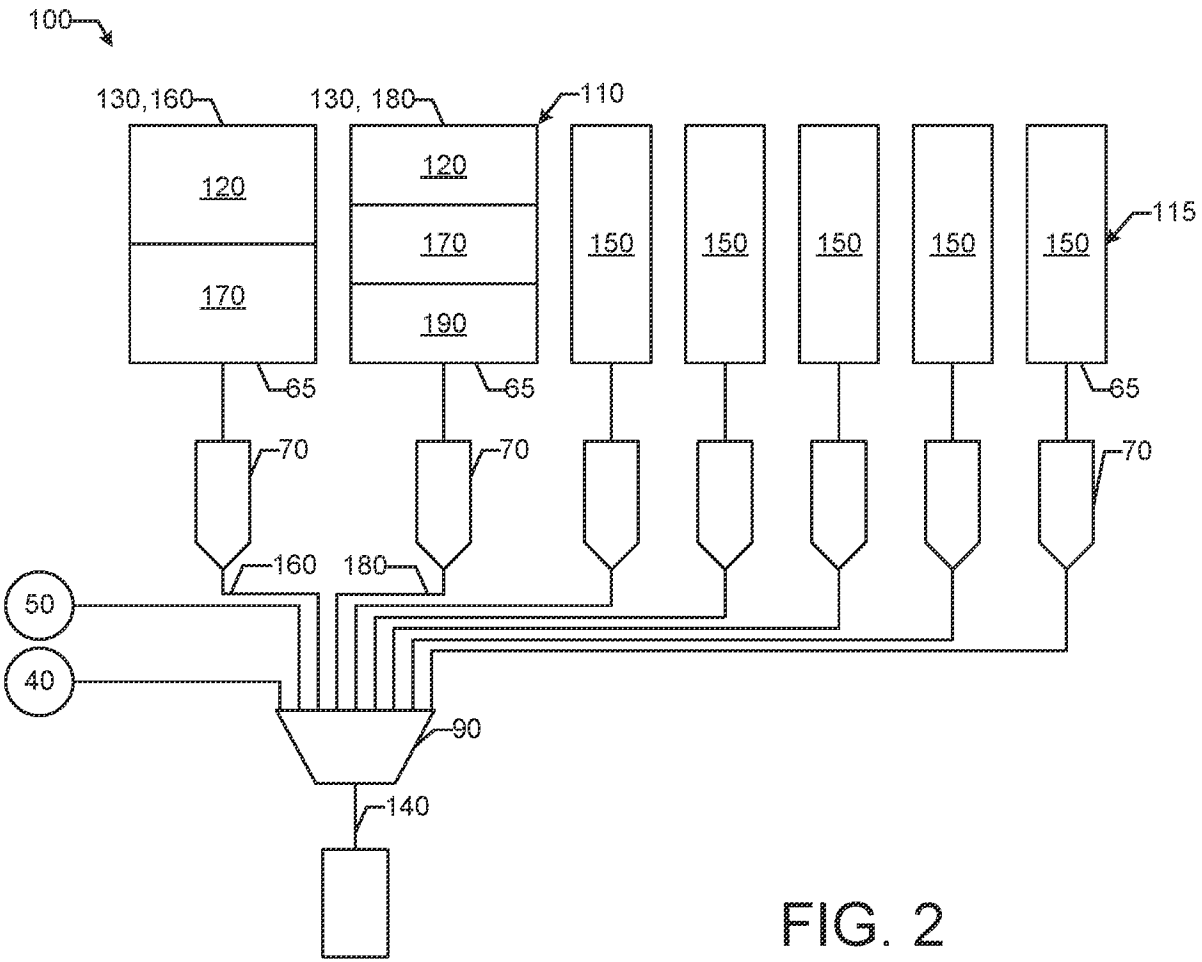
FIG. 2 is a schematic diagram of a beverage dispenser using macro-ingredients and micro-ingredients in a product rationalization system as may be described herein.

FIG. 2 shows an example of a beverage dispenser 100 as may be described herein. Similar to the beverage dispenser 10 described above, the beverage dispenser 100 may mix a number of ingredients. These ingredients may include the diluents 40 such as plain or carbonated water, the macro-ingredients 50 such as sweeteners, and any number of the micro-ingredients 60. The micro-ingredients 60 may be stored in a number of the cartridges 65. The diluents 40, the macro-ingredients 50, and the micro-ingredients 60 may be pumped to the dispensing nozzle 90 by the pumps 70, the metering devices 80, and the like. As used herein, the term "pump" will refer to conventional pumps, metering devices, and the like. The pumps 70 may be variable flow rate devices. Other components and other configurations may be used herein.

The beverage dispenser 100 also may include a product rationalization system 110. As described above, certain micro-ingredients 60 such as acids and/or non-acid ingredients may be stored in the cartridges 65 in differing concentrations and combinations. As described above, beverages may use citric acid, phosphoric acid, and the like in differing amounts and concentrations. Similarly, beverages containing phosphoric acid may or may not contain caffeine and/or other ingredients. Caffeine, however, may be unstable in a non-acidic liquid such that the caffeine needs to be dissolved in an acid solution. These ingredients then may be combined with other ingredients to form a completed "brand" beverage, i.e., any type of branded beverage such as a "COCA-COLA®" beverage, a "DIET COKE®" beverage, a "COKE ZERO®" beverage, and the like offered by The Coca-Cola Company of Atlanta, Ga. or otherwise.

The product rationalization system 110 thus may rationalize a number of different ingredients used in the beverage dispenser 100. Specifically, the product rationalization system 110 may combine one or more ingredients 115, such as the micro-ingredients 60, with a carrier liquid 120 so as to form a beverage component 130. The carrier liquid 120 may be water and the like. The carrier liquid 120 also may be a micro-ingredient 60. Other types of fluids such as alcohol, food grade solvents, and the like also may be used. One or more of these beverage components 130 may be combined with other ingredients 115 to form a beverage brand 140. These other ingredients 115 also may be micro-ingredients 60 and the like and may be described herein as a beverage brand part two 150 to create the different beverage brands 140. Specifically, the beverage components 130 and the beverage brands part two 150 may be mixed with the diluent 40 and the macro-ingredient 50 at the dispensing nozzle 90 to create the beverage brand 140. Each beverage component 130 may be in a single cartridge 65 or otherwise positioned. Other components and other configurations also may be used herein.

By way of example, a first beverage component 160 of the beverage components 130 may include a first ingredient 170 of the ingredients 115 and the carrier liquid 120. The first ingredient 170 may be a micro-ingredient 60 such as, for example, phosphoric acid. The carrier liquid 120 may be water. A second beverage component 180 of the beverage components 130 may include the first ingredient 170, a second ingredient 190, and the carrier liquid 120. The second ingredient 190 may be a micro-ingredient 60 such as, for example, caffeine. The beverage components 160, 180, in turn, may be mixed with one or more of the beverage brands part two 150 to create the final beverage brand 140. Any number of the beverage components 130 with any number of the ingredients 115 may be used herein in any combination.

The product rationalization system 110 may vary the amount and combination of the ingredients 115 and the beverage components 130 to create the different beverage brands 140. FIGS. 3, 4, and 5 show the results of supplying the first beverage component 160 and the second beverage component 180 to the dispensing nozzle 90 at different flow rates. By way of example, the first beverage component 160 may include twenty percent (20%) of the first ingredient 170 while the second beverage component 180 may include ten percent (10%) of the first ingredient 170 and ten percent (10%) of the second ingredient 190. Specifically, FIG. 3 shows differing volumes of the first ingredient 170 in the first beverage component 160 for beverage brands 140 without the second ingredient 190. For example, if the flow rate of the first beverage ingredient 170 is, respectively, 10, 7.5, and 5 milliliters per second then the resultant flow rate of the first ingredient 170 is, respectively, 2, 1.5, and 1 milliliters per second. In this example, none of the second ingredient 190 is present. FIG. 4 shows different flow rates for the first ingredient 170 in the first beverage component 160 and with a constant flow rate for the second ingredient 190 in the second beverage component 180. Finally, FIG. 5 shows a constant flow rate of the first beverage component 170 in the first beverage component 160 and differing flow rates of the second beverage ingredient 190 in the second beverage component 180. Other flow rates and other combinations may be used herein. Each of the combinations shown above may be used to create a different beverage brand 140.

The product rationalization system 110 thus provides rationalization of different ingredients 115 across several beverage brands 140. Such rationalization may be useful when the first ingredient 170 may be independent of the second ingredient 190 but the second ingredient 190 is dependent on the first ingredient 170, e.g., phosphoric acid and caffeine. The two ingredients 115 thus may be rationalized into two beverage components 160, 180 where the first beverage component 160 contains only the first ingredient 170 and the second beverage component 180 contains both the first ingredient 170 and the second ingredient 190. By varying the flow rates of the first beverage component 160 and the second beverage component 180, the correct amount of the first ingredient 170 and the second ingredient 190 may be supplied to create the several different beverage brands 140.

The product rationalization system 110 thus may provide a net reduction in the number of required ingredient cartridges 65 so as to provide room for additional cartridges 65 for additional brands or flavors. Moreover, certain of the acid containing ingredients may be remotely located in a conventional bag-in-box container 55 so as to provide a cost reduction and further room for additional brands or flavors. The ingredients 115, the flow rates, and the combinations provided herein are for the purpose of example only. Many other types of ingredients 115, flow rates, and combinations may be used herein. For example, the product rationalization system 110 may use ingredients 115 other than micro-ingredients.

It should be apparent that the foregoing relates only to the preferred embodiments of the present application and the resultant patent. Numerous changes and modifications may be made herein by one of ordinary skill in the art without departing from the general spirit and scope of the invention as defined by the following claims and the equivalents thereof.

The invention claimed is:

1. A beverage dispensing system, comprising:

a nozzle;

a first beverage component in communication with the nozzle via a first pump;

the first beverage component comprising a first ingredient;

wherein the first ingredient comprises a micro-ingredient; and a first cartridge for the first beverage component;

a second beverage component in communication with the nozzle via a second pump;

the second beverage component comprising the first ingredient and a second ingredient;

a second cartridge for the second beverage component;

wherein the first pump and the second pump vary the flow rate of the first beverage component and the second beverage component to the nozzle.

2. The beverage dispensing system of claim 1, wherein the micro-ingredient comprises a reconstitution ratio of about ten to one or higher.

3. The beverage dispensing system of claim 1, wherein the first ingredient comprises an acid.

4. The beverage dispensing system of claim 3, wherein the second ingredient comprises caffeine.

5. The beverage dispensing system of claim 1, wherein the second ingredient comprises a micro-ingredient.

6. The beverage dispensing system of claim 1, wherein the first beverage component and the second beverage component comprise a carrier liquid.

7. The beverage dispensing system of claim 1, further comprising a plurality of beverage brands part two in communication with the nozzle.

8. The beverage dispensing system of claim 7, wherein the plurality of beverage brands part two comprises micro-ingredients.

9. The beverage dispensing system of claim 1, further comprising one or more macro-ingredients in communication with the nozzle.

10. The beverage dispensing system of claim 1, further comprising a diluent in communication with the nozzle.

11. The beverage dispensing system of claim 1, wherein the first pump comprise a metering device.

12. The beverage dispensing system of claim 1, wherein the first beverage component and the second beverage component form a beverage brand at the nozzle.

13. A method of rationalizing ingredients in a beverage dispenser, comprising:

flowing a first beverage component from a first cartridge to a nozzle;

wherein the first beverage component comprises a first ingredient;

wherein the first ingredient comprises a micro-ingredient;

flowing a second beverage component from a second cartridge to the nozzle;

wherein the second beverage component comprises the first ingredient and a second ingredient;

creating a first beverage brand by flowing the first beverage component to the nozzle at a first flow rate and flowing the second beverage component to the nozzle at a second flow rate; and creating a second beverage brand by flowing the first beverage component to the nozzle at a third flow rate and flowing the second beverage component to the nozzle at the second flow rate.

* * * * *